United States Patent [19]

Chu et al.

[11] Patent Number: 4,501,306

[45] Date of Patent: Feb. 26, 1985

[54] AUTOMATIC SYRINGE FILLING SYSTEM

[75] Inventors: George Chu, Sunnyvale; Sharon Casella, San Jose, both of Calif.

[73] Assignee: Collagen Corporation, Palo Alto, Calif.

[21] Appl. No.: 440,324

[22] Filed: Nov. 9, 1982

[51] Int. Cl.[3] ..... B65B 3/04

[52] U.S. Cl. ..... 141/94; 141/192; 141/257; 141/242

[58] Field of Search ..... 141/7, 26, 27, 195, 141/95, 94, 207, 21–25, 28, 18, 192, 193, 243, 237, 246, 247, 238, 242, 244, 245

[56] References Cited

U.S. PATENT DOCUMENTS

| | | | |
|---|---|---|---|
| 2,646,199 | 7/1953 | Paulsen | 141/195 X |
| 2,652,961 | 9/1953 | Sherbondy | 141/195 |
| 3,498,342 | 3/1970 | Sanderson | 141/238 |
| 3,760,556 | 9/1973 | Morris | 141/195 |
| 3,833,030 | 9/1974 | Waldbauer, Jr. et al. | 141/26 |
| 3,935,883 | 2/1976 | Stach et al. | 141/27 |
| 3,949,746 | 4/1976 | Wallach | 141/243 X |
| 4,010,747 | 3/1977 | Clark et al. | 141/7 |
| 4,373,560 | 2/1983 | Elsworth | 141/242 X |

FOREIGN PATENT DOCUMENTS

| | | | |
|---|---|---|---|
| 184826 | 8/1922 | United Kingdom | 141/242 |

*Primary Examiner*—Stephen Marcus

*Attorney, Agent, or Firm*—Ciotti & Murashige

[57] ABSTRACT

An automatic syringe filling system includes a pump for supplying liquid under pressure to a manifold that distributes the liquid to each of a plurality of syringes. Microswitches disposed at predetermined positions detect when the plunger of each syringe connected to the manifold has been extended a particular distance determined by the desired fill volume. When all of the plungers are extended this distance, the supply of liquid to the manifold is discontinued by closing a valve and deactuating the pump.

24 Claims, 6 Drawing Figures

FIG. 4.
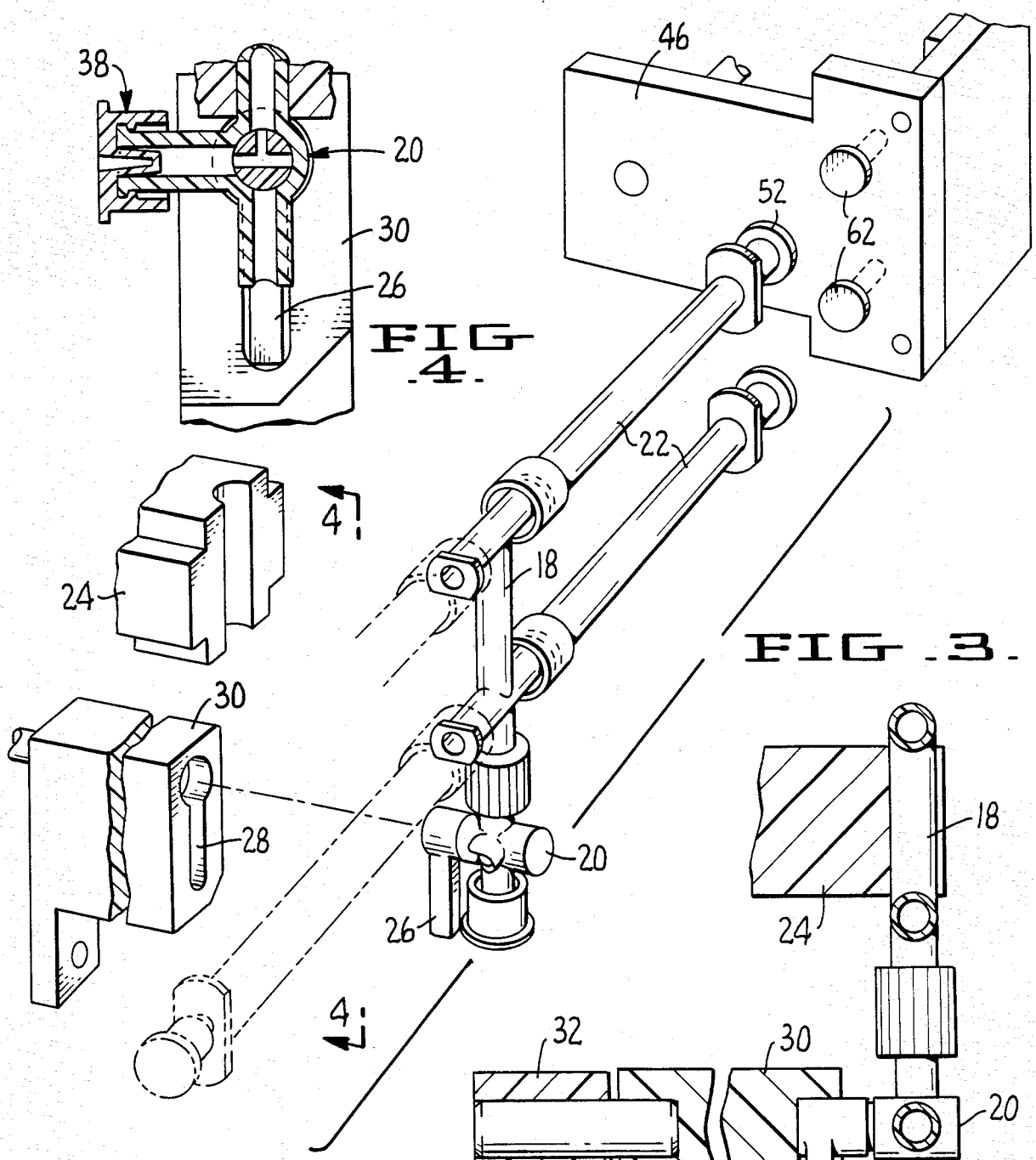
FIG. 3.
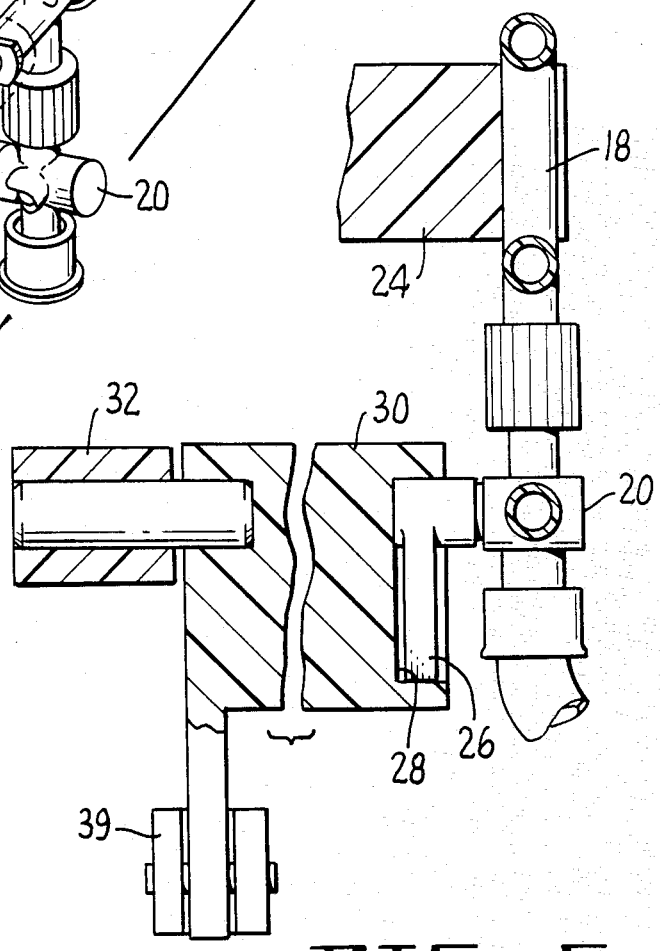
FIG. 5.

AUTOMATIC SYRINGE FILLING SYSTEM

BACKGROUND OF THE INVENTION

The present invention relates to the filling of syringes with a liquid such as a medicine or other injectable product, and more particularly to a system for automatically and simultaneously filling each of a plurality of syringes with a predetermined amount of the liquid.

In the past, the filling of syringes with liquid product has been done individually for each syringe, typically being carried out either totally manually or with the aid of a machine that required at least manual control. The most basic method for filling a syringe is to insert the end of a hollow needle attached to the syringe into a container of the liquid product. The plunger on the syringe is withdrawn until the barrel of the syringe is observed to be filled with the desired amount of product.

Variations of this method have involved the use of metering devices to control the amount of liquid drawn into the syringe. For example, U.S. Pat. Nos. 3,875,979 and 3,907,009 disclose metering devices that include adjustably positioned gauge plates that limit the distance that the plunger can be extracted from the barrel of the syringe. These devices merely provide assistance in regulating the amount of liquid that fills the syringe, and do not eliminate or reduce the need for manually effecting the filling process for each syringe.

More recently, the filling approach has involved the use of a pump to provide the liquid product under pressure to the syringe. By opening a valve connected between the pump and the syringe, the pressurized liquid is allowed to enter the syringe and push the plunger outwardly. When the proper amount of liquid is in the syringe, the valve is closed. Although this approach does not require the manual withdrawal of the plunger to fill the syringe, it still does not reduce the need for manual assistance. More specifically, the operator must remain present to monitor the filling and to close the valve at the appropriate time.

It will be appreciated that there are two significant limitations associated with each of the foregoing syringe-filling techniques. The first of these is the requirement for the continued presence of a human operator during the entirety of the time that each syringe is being filled to either effect or control the filling operation. Secondly, since the syringes are filled one at a time, there are practical limitations on the production rate, i.e. the number of syringes that can be filled in a unit time period. Typically, a skilled and experienced operator can only fill about a dozen syringes per minute using the foregoing techniques.

An automated device for filling syringes is disclosed in U.S. Pat. No. 3,935,883. In this device, the piston of a large-volume pumping syringe is connected to a reciprocal driving motor. The cylinder of the pumping syringe is connected to a bulk source container by one check valve and to the syringe to be filled by another check valve. In operation, the piston is withdrawn from the cylinder by the driving motor to draw liquid into the cylinder from the container. On the return stroke, the liquid is pumped out into the syringe. By adjusting the position of an eccentric member connected between the piston and the driving motor, the length of its stroke and hence the amount of fluid pumped during each stroke can be varied.

While the automation provided by this device is helpful in reducing the need for manual input during the entire filling operation, it does not overcome the second limitation discussed previously. That is, each syringe is still filled on an individual basis. Consequently, the practical limitation on the rate of filling continues to be a factor.

OBJECTS AND BRIEF SUMMARY OF THE INVENTION

Accordingly, it is a general object of the present invention to provide a novel syringe filling system that enables syringes to be filled at a faster rate than that which can be achieved using prior techniques.

It is a more specific object of the present invention to provide a novel system for filling a plurality of syringes with predetermined volumes of liquid simultaneously.

It is another object of the present invention to provide a novel syringe filling system that operates automatically, thereby reducing the amount of time that an operator must devote specifically to the filling process.

It is a further object of the present invention to provide an automatic syringe filling system that can be adjusted to accomodate different fill volume requirements in a simple yet accurate manner.

It is yet another object of the present invention to provide a novel syringe filling system that accomplishes each of the foregoing objectives under aseptic conditions.

Broadly speaking, these objects are achieved in accordance with the present invention by a system that includes a pump for supplying the liquid under pressure to a manifold that distributes the liquid to each of a plurality of syringes. Sensors, e.g. microswitches, are disposed at predetermined positions to detect when the plunger of each syringe connected to the manifold has been extended a particular distance determined by the desired fill volume. When all of the plungers are extended this distance, the supply of liquid to the manifold is discontinued, for example by closing a valve and deactuating the pump.

It has been found that the rate at which syringes can be filled is significantly increased with a system incorporating the present invention. For example, when four syringes are connected to the manifold, 20–24 syringes can be easily filled per minute.

In a further feature of the invention, the microswitches are mounted on limit plates that inhibit the plungers from being extended beyond the specified distance. This feature assures accurate filling of each syringe by the proper amount, even when they fill at different rates.

The positioning of the limit plates and actuation of the pump and valve is controlled totally automatically by a timer or the like, to free the operator to perform other tasks during a filling operation.

Further features of the present invention and the advantages provided thereby will become apparent to those of ordinary skill in the art upon a perusal of the following detailed description of a preferred embodiment of the invention illustrated in the accompanying drawings.

BRIEF DESCRIPTION OF THE DRAWINGS

FIG. 3 is an exploded view of the valve, manifold and microswitch assembly of the filling system;

FIG. 4 is a cross-sectional front view of the filling valve, taken along the section line 4—4 of FIG. 3;

FIG. 5 is a cross-sectional side view of the filling valve actuator; and

DETAILED DESCRIPTION

In the following description of a preferred embodiment of the invention, the filling of four syringes at a time is illustrated to facilitate an understanding of the invention. It will be appreciated by those having an ordinary level of skill in the art that the invention is not so limited. Rather, it can be extended to the filling of any number of syringes simultaneously, as long as the components that are used to construct the system have appropriate operating characteristics.

Figures 1, 2:
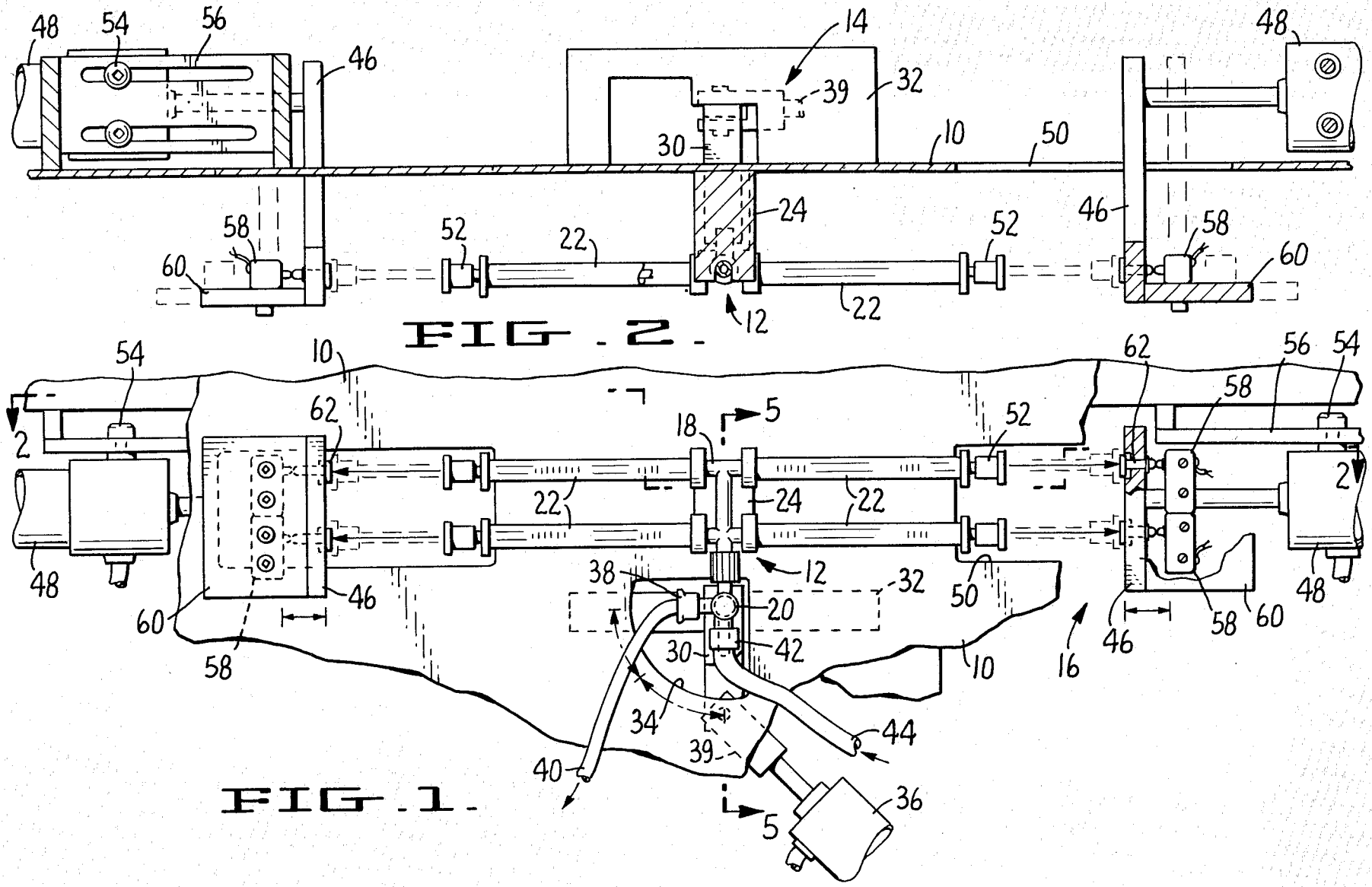
FIG. 1 is a front view, partly in section, of a syringe filling system constructed in accordance with the present invention.
FIG. 2 is a sectional top view of the syringe filling system, taken along the section line 2—2 of FIG. 1.

Referring generally to FIGS. 1 and 2, the components comprising the filling system are mounted on a vertical cover plate 10 supported on a suitable frame (not shown). These components basically comprise a valve and manifold assembly 12, a valve actuating and support assembly 14, and a microswitch/limit plate assembly 16.

The valve and manifold assembly 12 is a separate unit that is assembled and attached to the plate 10 for each filling operation. It includes a female luer manifold 18 and a three-way stopcock valve 20 having a male luer adapter that is connected to an input port of the manifold. The manifold has a plurality of output ports with female luer adapters to which syringes 22 are respectively connected. The manifold 18 and the valve 20 can be disposable, with new ones being used for each filling operation, to prevent cross-contamination.

The manifold 18 with the valve 20 and the syringes 22 attached forms a rigid assembly that is mounted to a clip 24 on the plate 10 in the manner illustrated in FIG. 1. When so mounted, the control lever 26 of the valve 20 fits into corresponding slot 28 in a valve actuator 30, as best illustrated in FIG. 3. The actuator 30 is pivotally supported by a mounting bracket 32 on the opposite side of the plate 10 from the clip 24. A portion of the actuator 30 projects through an opening 34 in the plate. The opening 34 is appropriately shaped to permit the actuator and the valve lever 26 to move 90° from the vertical position illustrated in FIGS. 1 and 3 to a horizontal position (not shown).

This movement of the actuator and the lever is effected by a 3-position hydraulic or pneumatic cylinder/piston system 36. A clevis 38 or the like connects the piston of the system to the end of the actuator 30 that is remote from its pivotal connection to the bracket. The cylinder is suitably attached to the stationary frame. Through appropriate actuation, the cylinder/piston system selectively moves the actuator 30 and the valve lever 26 to each of a vertical position, a horizontal position, and an intermediate position at approximately 45° relative to these two other positions. With its handle in the vertical position, the valve connects the manifold 18 with one input port 38. This input port is connected to a vacuum source by means of a tube 40. Moving the handle to the horizontal position connects the manifold to the other input port 42 of the valve 20 and disconnects it from the port 38. The input port 42 is connected to a fluid pump by means of a second tube 44. In the intermediate position of the handle, both input ports are closed off from the manifold.

The illustrated embodiment of the invention includes two microswitch/limit plate assemblies 16, one each being associated with two of the syringes 22. Each assembly includes a limit plate 46 supported on the piston rod of a cylinder/piston assembly 48. The cylinder is mounted to the plate 10 (or the frame) and moves the limit plate 46 between a retracted, inoperative position and an extended position. The limit plate has a portion which projects through a slot 50 in the cover plate 10 and is engaged by the plungers 52 of the syringes 22 when they are filled with the proper amount of fluid and the plates are in the extended position. To permit different fill volumes to be obtained, each cylinder 48 is adjustably mounted on the plate 10 by means of bolts 54 slidably engaged in slots in a mounting bracket 56. The cover plate 10 can be provided with calibration marks (not shown) adjacent each slot 50 to facilitate the positioning of the cylinders and the limit plates.

Each limit plate supports two microswitches 58 by means of a mounting plate 60 attached to its projecting portion. A plunger pin 62 is associated with each microswitch. The plunger pins extend through the limit plate 46 and have heads that protrude slightly above the surface of the limit plate on the side adjacent the syringes, so as to be respectively engaged by their plungers when the syringes are filled with the desired volumes. This engagement causes each plunger pin to actuate its associated microswitch.

Figure 6:
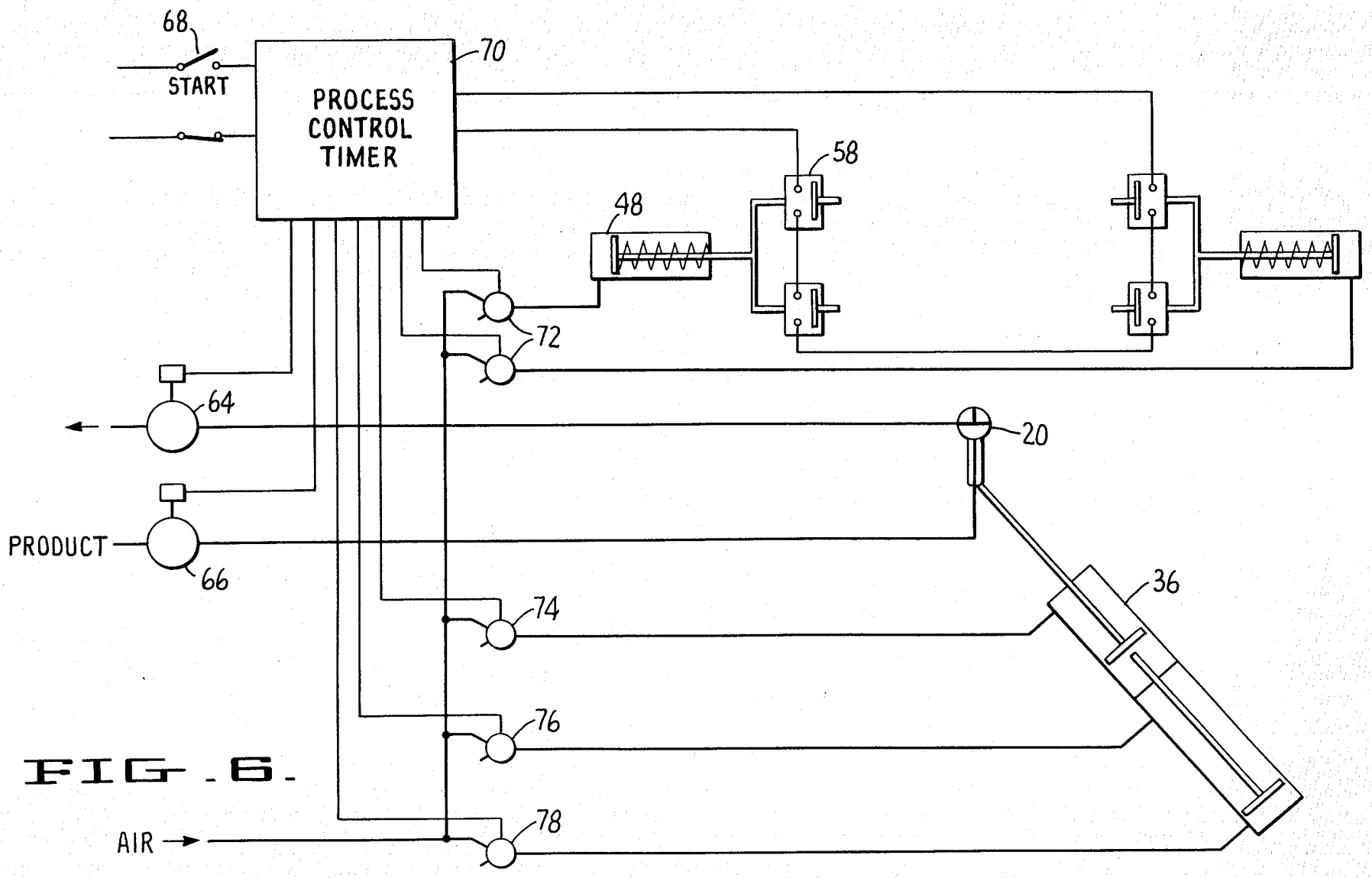
FIG. 6 is a fluidic and electrical schematic circuit diagram of the control circuit for the filling system.

The operation of the syringe filling system is explained with reference to the control circuit diagram of FIG. 6. To set up the system, the operator assembles a valve and manifold assembly by connecting four syringes 22 and a three-way stopcock valve 20 to the associated adapters on a female luer manifold 18. The input port 38 of the valve is connected to a vacuum pump 64 by the tube 40, and the input port 42 is connected to a fluid pump 66 by the tube 44. The input port of the pump 66 is connected to a source of the liquid product with which the syringes are to be filled. At this point the handle 26 of the valve is in the intermediate position so that both input ports are closed off from the manifold 18.

Once assembled, the valve and manifold assembly is mounted on the cover plate 10 by means of the clip 24. When so mounted, the handle 26 of the valve 20 is disposed within the slot 28 of the actuator 30.

To begin the automatic filling sequence, the operator actuates a start switch 68 to send a signal to a process control timer 70. This timer could be an 800 Module manufactured by Control Technology Corporation of Massachusetts, for example, or similar such circuitry. Upon receipt of the start signal, the timer 70 actuates two solenoid controlled valves 72 to extend the cylinders 48 and move the limit plates 46 toward each other to their operative positions. The timer also actuates the vacuum pump 64 and another solenoid-controlled valve 74 to cause the 3-position cylinder 36 to retract from its intermediate position and move the stopcock valve to connect the manifold 18 to the pump 64. This action evacuates air trapped in the tips of the syringes and also helps to break any seal between the plunger and the cylinder of each syringe.

After a suitable time delay, the timer deactuates the valve 74 and actuates two solenoid-controlled valves 76 and 78 to extend the cylinder 36 fully and thereby connect the manifold 18 with the product feeding pump 66. The timer also actuates the pump 66, to cause the syringes to be filled with the product.

As the syringes are being filled, their plungers 52 extend outwardly until they contact the plunger pins 62 to actuate their associated microswitches. The microswitches are electrically connected in series, and when all four of them are actuated as the designated fill volumes are attained, a signal is sent to the timer 70. Upon receipt of this signal, the timer deactuates the valve 76 and actuates the valve 74 to retract the cylinder to its intermediate position and thereby close the valve 20. The timer also deactuates the filling pump 66. Thereafter, the valves 72 are deactuated to retract the cylinders and withdraw the limit plates.

At this time the automatic filling sequence is completed. The syringes 22 can be disconnected from the manifold 18, sealed and packaged.

In case of uneven filling of the syringes, e.g. one syringe sticks and fills more slowly than the others, the faster filling syringes will be physically prevented from filling beyond the designated fill volume by the limit plate 46. In other words, as each syringe is filled to the designated volume, further flow of product into that syringe will be inhibited and it will be diverted to the syringes that are yet to be filled, until all microswitches are actuated. Thus when a highly viscous product is being charged into the syringes, it may reach the syringes farthest from the valve 20 more slowly than it does those nearest the valve. However, all syringes will be filled to the proper volume before the filling cycle is ended.

From the foregoing it will be appreciated that the present invention provides a system for automatically filling a plurality of syringes at one time with a designated volume of liquid. The primary advantage of the system is the increased filling rate that it offers over previous techniques. In addition, it frees the operator to perform other useful tasks during the actual filling process.

It will be appreciated by those of ordinary skill in the art that the present invention can be embodied in other specific forms without departing from the spirit or essential characteristics thereof. The presently disclosed embodiment is therefore considered in all respects to be illustrative and not restrictive. The scope of the invention is indicated by the appended claims rather than the foregoing description, and all changes that come within the meaning and range of equivalents thereof are intended to be embraced therein.

We claim:

1. Apparatus for automatically filling each of a plurality of syringes substantially simultaneously with a predetermined amount of fluid, comprising:

a manifold having an input port for receiving the fluid and a plurality of output ports each adapted to be connected to one of said plurality of syringes;

a single pump for supplying the fluid to the input port of said manifold;

a plurality of detectors respectively located at predetermined spaced positions from the output ports of said manifold so as to detect when the plunger of each syringe connected to said manifold has been extended a predetermined amount; and means responsive to said detectors for interrupting the supply of fluid to said manifold when all of the plungers of syringes connected to said manifold have been extended by said predetermined amount.

2. The apparatus of claim 1 wherein said interrupting means includes a valve interposed between said pump and said input port that is closed in response to detection of all of the plungers being extended by said predetermined amount.

3. The apparatus of claim 1 wherein said interrupting means includes means for deactuating said pump.

4. The apparatus of claim 2 wherein said valve is a three-way valve having a common port connected to said input port of said manifold, one input port connected to said pump, and a second input port connected to a source of vacuum.

5. The apparatus of claim 4 further including means responsive to a signal indicating the initiation of a filling sequence for automatically actuating said valve to first connect said manifold to said source of vacuum and subsequently connect said manifold to said pump.

6. The apparatus of claim 5 wherein said actuating means includes a three-position cylinder/piston system connected to said valve.

7. The apparatus of claim 1 wherein said predetermined spaced positions for said detectors are adjustable.

8. The apparatus of claim 1 further including means for limiting the amount by which the plungers of syringes connected to said manifold can be extended.

9. The apparatus of claim 8 wherein said limiting means comprises at least one limit plate disposed at at least one of said predetermined spaced positions.

10. The apparatus of claim 9 wherein at least one of said detectors is mounted on said limit plate.

11. The apparatus of claim 9 further including means for moving said limit plate between said predetermined spaced position and a remote position.

12. The apparatus of claim 11 wherein said moving means includes an adjustably positionable cylinder/piston arrangement.

13. The apparatus of claim 1 wherein said detectors comprise microswitches.

14. A system for automatically filling each of a plurality of syringes substantally simultaneously with a predetermined amount of fluid, comprising:

a manifold having an inlet port for receiving the fluid and a plurality of output ports each adapted to be connected to one of said plurality of syringes;

a single pump for supplying the fluid under pressure to said manifold;

a valve for selectively placing said pump in fluid communication with said manifold;

support means adapted to be connected to each of said plurality of syringes to support said syringes at respective predetermined positions;

a limit plate disposed at a predetermined distance from said support means so as to be contacted by the plunger of a at least one syringe connected to said support means during the filling thereof, said distance being related to said predetermined amount of fluid;

sensing means for detecting when the plunger of each syringe connected to said support means is extended a certain distance by virtue of the syringe being filled with said predetermined amount of fluid; and means responsive to a signal from said sensing means indicating that the plungers of all syringes connected to said support means are extended said certain distance for deactuating at least one of said pump and said valve to thereby interrupt the supply of fluid to said manifold.

15. The system of claim 14 wherein said manifold forms part of said support means.

16. The system of claim 14 wherein said sensing means includes a plurality of microswitches, at least one of which is mounted on said limit plate.

17. The system of claim 14 wherein said valve also selectively connects said manifold to a vacuum source.

18. The system of claim 14 wherein said predetermined distance is adjustable.

19. The system of claim 14 wherein the means responsive to a signal from said sensing means is for deactuating said valve.

20. The system of claim 14 which further includes means for moving said limit plate between said predetermined distance and a remote position.

21. An apparatus for automatically filling a syringe with a predetermined amount of fluid, comprising:

a pump for supplying the fluid under pressure;

means for supporting a syringe to be filled at a predetermined location;

a valve for selectively placing the pump in fluid communication with a syringe supported by said support means to thereby fill the same;

sensing means for detecting when the plunger of a syringe supported by the support means has extended a predetermined distance during the filling thereof, said distance being related to said predetermined amount of fluid; and means responsive to said sensing means for deactuating said valve to thereby interrupt the supply of fluid to a syringe supported by the support means.

22. The apparatus of claim 21 further including a limit plate for inhibiting the plunger of a syringe supported by said support means from being extended beyond said predetermined distance.

23. The apparatus of claim 22 wherein said sensing means comprises a microswitch mounted on said limit plate.

24. The apparatus of claim 22 which further includes a means for moving said limit plate between said predetermined distance and a remote position.

* * * * *